US009382790B2

(12) United States Patent
Bertoja et al.

(10) Patent No.: US 9,382,790 B2
(45) Date of Patent: Jul. 5, 2016

(54) METHOD AND APPARATUS FOR COMPLETING A MULTI-STAGE WELL

(75) Inventors: Michael J. Bertoja, Bellaire, TX (US); Robert A. Parrott, Sugar Land, TX (US); Bruno Lecerf, Novosibirsk (RU); Vitaliy Timoshenko, Novosibirsk (RU); Sergey Balakin, Novosibirsk (RU); Elena Tarasova, Solnechnyj (RU); Gary Rytlewski, League City, TX (US); Billy Anthony, Missouri City, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 548 days.

(21) Appl. No.: 13/197,450

(22) Filed: Aug. 3, 2011

(65) Prior Publication Data

US 2012/0168163 A1 Jul. 5, 2012

Related U.S. Application Data

(60) Provisional application No. 61/427,901, filed on Dec. 29, 2010.

(51) Int. Cl.

| | |
|---|---|
| ***E21B 43/11*** | (2006.01) |
| ***E21B 34/00*** | (2006.01) |
| ***E21B 34/14*** | (2006.01) |
| ***E21B 43/25*** | (2006.01) |
| ***E21B 23/04*** | (2006.01) |
| ***E21B 43/26*** | (2006.01) |

(52) U.S. Cl.

CPC ..... *E21B 43/25* (2013.01); *E21B 23/04* (2013.01); *E21B 34/14* (2013.01); *E21B 43/11* (2013.01); *E21B 43/26* (2013.01); *E21B 2034/007* (2013.01)

(58) Field of Classification Search

CPC ..... E21B 34/14; E21B 43/14; E21B 43/25; E21B 43/26; E21B 2034/007; E21B 23/08

USPC ..... 166/297, 193, 194, 321, 386, 374, 166/308.1, 307, 318, 332.1

See application file for complete search history.

(56) References Cited

U.S. PATENT DOCUMENTS

| | | | |
|---|---|---|---|
| 3,011,548 | A | 12/1961 | Holt |
| 3,054,415 | A | 9/1962 | Baker et al. |
| 3,263,752 | A | 8/1966 | Conrad |

(Continued)

FOREIGN PATENT DOCUMENTS

| | | | |
|---|---|---|---|
| CN | 201372774 | | 12/2009 |
| EA | 200801941 | A1 | 4/2009 |

(Continued)

OTHER PUBLICATIONS

Al-Matar, et al., "The Right Treatment for the Right Reservoir", Oilfield Review, vol. 20, Issue 2., Jun. 1, 2008, pp. 4-17.

(Continued)

*Primary Examiner* — Blake Michener
(74) *Attorney, Agent, or Firm* — Jeffery R. Peterson

(57) ABSTRACT

An apparatus includes a string that extends into a well and a tool that is disposed in the string. The tool is adapted to form a seat to catch an object communicated to the tool via a passageway of the string in response to the tool being perforated.

10 Claims, 15 Drawing Sheets

(56) References Cited

U.S. PATENT DOCUMENTS

| | | | | |
|---|---|---|---|---|
| 3,269,463 | A | 8/1966 | Page, Jr. | |
| 3,995,692 | A | 12/1976 | Seitz | |
| 4,064,937 | A | 12/1977 | Barrington | |
| 4,355,686 | A | 10/1982 | Arendt | |
| 4,729,432 | A | 3/1988 | Helms | |
| 4,771,831 | A | 9/1988 | Pringle et al. | |
| 5,183,114 | A | 2/1993 | Mashaw, Jr. et al. | |
| 5,224,044 | A | 6/1993 | Tamura et al. | |
| 5,295,393 | A | 3/1994 | Thiercelin | |
| 5,333,692 | A | 8/1994 | Baugh et al. | |
| 5,526,888 | A | 6/1996 | Gazewood | |
| 5,921,318 | A | 7/1999 | Ross | |
| 5,988,285 | A | 11/1999 | Tucker et al. | |
| 6,006,838 | A | 12/1999 | Whiteley et al. | |
| 6,059,032 | A | 5/2000 | Jones | |
| 6,155,342 | A | 12/2000 | Oneal et al. | |
| 6,206,095 | B1 | 3/2001 | Baugh | |
| 6,216,785 | B1 | 4/2001 | Achee, Jr. et al. | |
| 6,302,199 | B1 | 10/2001 | Hawkins et al. | |
| 6,334,486 | B1 | 1/2002 | Carmody et al. | |
| 6,371,208 | B1 | 4/2002 | Norman et al. | |
| 6,394,183 | B1 | 5/2002 | Schrenkel et al. | |
| 6,443,228 | B1 | 9/2002 | Aronstam et al. | |
| 6,543,538 | B2 | 4/2003 | Tolman et al. | |
| 6,634,429 | B2 | 10/2003 | Henderson et al. | |
| 6,907,936 | B2 | 6/2005 | Fehr et al. | |
| 6,997,263 | B2 | 2/2006 | Campbell et al. | |
| 7,066,265 | B2 | 6/2006 | Surjaatmadja | |
| 7,093,664 | B2 | 8/2006 | Todd et al. | |
| 7,108,067 | B2 | 9/2006 | Themig et al. | |
| 7,134,505 | B2 | 11/2006 | Fehr et al. | |
| 7,168,494 | B2 | 1/2007 | Starr et al. | |
| 7,210,533 | B2 | 5/2007 | Starr et al. | |
| 7,322,417 | B2 * | 1/2008 | Rytlewski et al. | 166/313 |
| 7,325,617 | B2 | 2/2008 | Murray | |
| 7,353,879 | B2 | 4/2008 | Todd et al. | |
| 7,377,321 | B2 | 5/2008 | Rytlewski | |
| 7,387,165 | B2 | 6/2008 | Lopez de Cardenas et al. | |
| 7,431,091 | B2 | 10/2008 | Themig et al. | |
| 7,464,764 | B2 | 12/2008 | Xu | |
| 7,490,669 | B2 | 2/2009 | Walker et al. | |
| 7,522,779 | B2 | 4/2009 | Fu et al. | |
| 7,543,634 | B2 | 6/2009 | Fehr et al. | |
| 7,543,647 | B2 | 6/2009 | Walker | |
| 7,571,765 | B2 | 8/2009 | Themig | |
| 7,575,062 | B2 | 8/2009 | East, Jr. | |
| 7,637,323 | B2 | 12/2009 | Schasteen et al. | |
| 7,661,481 | B2 | 2/2010 | Todd et al. | |
| 7,748,460 | B2 | 7/2010 | Themig et al. | |
| 7,832,472 | B2 | 11/2010 | Themig | |
| 7,891,774 | B2 | 2/2011 | Silverbrook | |
| 8,505,632 | B2 * | 8/2013 | Guerrero et al. | 166/373 |
| 8,668,006 | B2 * | 3/2014 | Xu | 166/193 |
| 8,839,873 | B2 * | 9/2014 | Johnson et al. | 166/386 |
| 2003/0180094 | A1 | 9/2003 | Madison | |
| 2004/0118564 | A1 | 6/2004 | Themig et al. | |
| 2004/0163820 | A1 | 8/2004 | Bishop et al. | |
| 2004/0262016 | A1 | 12/2004 | Farquhar | |
| 2006/0124310 | A1 | 6/2006 | Lopez de Cardenas et al. | |
| 2006/0124311 | A1 * | 6/2006 | Lopez de Cardenas et al. | 166/313 |
| 2006/0124312 | A1 * | 6/2006 | Rytlewski et al. | 166/313 |
| 2006/0207764 | A1 | 9/2006 | Rytlewski | |
| 2006/0213670 | A1 * | 9/2006 | Bishop et al. | 166/386 |
| 2006/0243455 | A1 | 11/2006 | Telfer et al. | |
| 2007/0044958 | A1 | 3/2007 | Rytlewski et al. | |
| 2007/0107908 | A1 | 5/2007 | Vaidya et al. | |
| 2007/0181224 | A1 | 8/2007 | Marya et al. | |
| 2007/0221384 | A1 * | 9/2007 | Murray | 166/376 |
| 2007/0272413 | A1 | 11/2007 | Rytlewski et al. | |
| 2007/0284097 | A1 | 12/2007 | Swor et al. | |
| 2008/0000697 | A1 * | 1/2008 | Rytlewski | 175/317 |
| 2008/0105438 | A1 | 5/2008 | Jordan et al. | |
| 2008/0210429 | A1 | 9/2008 | McMillin et al. | |
| 2009/0056934 | A1 | 3/2009 | Xu | |
| 2010/0101803 | A1 | 4/2010 | Clayton et al. | |
| 2010/0132954 | A1 | 6/2010 | Telfer | |
| 2010/0209288 | A1 | 8/2010 | Marya | |
| 2010/0212911 | A1 * | 8/2010 | Chen et al. | 166/373 |
| 2011/0056692 | A1 | 3/2011 | Lopez de Cardenas et al. | |
| 2011/0127047 | A1 | 6/2011 | Themig et al. | |
| 2011/0180274 | A1 * | 7/2011 | Wang et al. | 166/386 |
| 2011/0278010 | A1 | 11/2011 | Fehr et al. | |
| 2012/0085538 | A1 | 4/2012 | Guerrero et al. | |
| 2013/0000926 | A1 * | 1/2013 | Parrott et al. | 166/386 |

FOREIGN PATENT DOCUMENTS

| | | | |
|---|---|---|---|
| RU | 2314415 | C2 | 1/2008 |
| RU | 2395667 | C1 | 7/2010 |
| WO | 03095794 | A1 | 11/2003 |
| WO | 2004088091 | A1 | 10/2004 |
| WO | 2009029437 | A1 | 3/2009 |
| WO | 2010132345 | A2 | 11/2010 |
| WO | 2012091926 | A2 | 7/2012 |

OTHER PUBLICATIONS

McDaniel, et al., "Horizontal Wells with Multistage Fracs Prove to be Best Economic Completion for Many Low-Permeability Reservoirs", SPE 125903—SPE Eastern Regional Meeting, Charleston, West Virginia, Sep. 23-25, 2009, 15 pages.

Thomson, D. W., and Nazroo, M. F., Design and Installation of a Cost-Effective Completion System for Horizontal Chalk Wells Where Multiple Zones Require Acid Stimulation, SPE 51177 (a revision of SPE 39150), Offshore Technology Conference, May 1997, Houston, TX, USA.

Lonnes, S. B., Nygaard, K. J., Sorem, W. A., Hall, T. J., Tolman, R. C., Advanced Multizone Stimulation Technology, SPE 95778, Presented at the 2005 SPE Annual Technical Conference and Exhibition, Oct. 9-12, 2005, Dallas, TX, USA.

Rytlewski, G., Multiple-Layer Commpletions for Efficient Treatment of Multilayer Reservoirs, IADC/SPE 112476, Presented at the 2008 IADC/SPE Drilling Conference, Mar. 4-6, 2008, Orlando, FL, USA.

Examination Report issued in CA2823127 on Jan. 26, 2015, 5 pages.

Official Action issued in CN201180063782.8 on May 6, 2015, 11 pages.

Decision on Grant issued in RU2013135307 on Sep. 15, 2014, 9 pages.

* cited by examiner

METHOD AND APPARATUS FOR COMPLETING A MULTI-STAGE WELL

This application claims the benefit under 35 U.S.C. §119 (e) to U.S. Provisional Patent Application Ser. No. 61/427,901 entitled, "COMPLETION AND METHOD FOR MULTI-STAGE WELL WITH VALVES ACTUATED BY PERFORATING," which was filed on Dec. 29, 2010, and is hereby incorporated by reference in its entirety.

TECHNICAL FIELD

The disclosure generally relates to a technique and apparatus for completing a multi-stage well.

BACKGROUND

For purposes of preparing a well for the production of oil or gas, at least one perforating gun may be deployed into the well via a deployment mechanism, such as a wireline or a coiled tubing string. The shaped charges of the perforating gun(s) are fired when the gun(s) are appropriately positioned to perforate a tubing of the well and form perforating tunnels into the surrounding formation. Additional operations may be performed in the well to increase the well's permeability, such as well stimulation operations, for example operations that involve hydraulic fracturing. All of these operations typically are multiple stage operations, which means that each operation typically involves isolating a particular zone, or stage, of the well, performing the operation and then proceeding to the next stage. Typically, a multiple stage operation involves several runs, or trips, into the well.

SUMMARY

In an embodiment of the invention, a technique includes deploying a tubing string that includes a tool in a well; and perforating a designated region of the tool to cause the tool to automatically form a seat to catch an object communicated to the tool via the tubing string.

In another embodiment of the invention, an apparatus includes a string that extends into a well and a tool that is disposed in the string. The tool is adapted to form a seat to catch an object communicated to the tool via a passageway of the string in response to the tool being perforated.

In another embodiment of the invention, a downhole tool usable with a well includes a housing, a chamber that is formed in the housing, a compressible element and an operator mandrel. The housing is adapted to be form part of a tubular string. The compressible element has an uncompressed state in which an opening through the compressible element has a larger size and a compressed state in which the opening has a smaller size to form a seat to catch an object that is communicated to the tool through the string. The operator mandrel is in communication with the chamber; and the operator mandrel is adapted to be biased by pressure exerted by the chamber to retain the compressible element in the uncompressed state and in response to the chamber being perforated, compress the compressible element to transition the compressible element from the uncompressed state to the compressed state.

In yet another embodiment of the invention, a downhole tool usable with a well includes a housing; a chamber formed in the housing; first and second compressible elements; and a valve. The housing forms part of a tubular string. The first compressible element has an uncompressed state in which an opening through the first compressible element has a larger size and a compressed state in which the opening has a smaller size to form a first seat to catch a first object communicated to the tool through the string. The first compressible element is adapted to translate in response to the first object landing in the first seat to create a fluid tight barrier and the string being pressurized using the barrier; and the first compressible element is adapted to transition from the uncompressed state to the compressed state in response to the chamber being perforated. The valve is adapted to open to allow fluid communicating between the passageway and a region outside of the string surrounding a passageway of the housing in response to the translation of the first compressible element. The second compressible element has an uncompressed state in which an opening through the second compressible element has a larger size and a compressed state in which the opening through the second compressible element has a smaller size to form a second seat to catch a second object communicated to the tool through the string. The second compressible element is adapted to transition from the uncompressed state to the compressed state in response to the translation of the first compressible element.

Advantages and other features of the invention will become apparent from the following drawing, description and claims.

DETAILED DESCRIPTION

In the following description, numerous details are set forth to provide an understanding of the present invention. However, it will be understood by those skilled in the art that the present invention may be practiced without these details and that numerous variations or modifications from the described embodiments are possible.

As used herein, terms, such as "up" and "down"; "upper" and "lower"; "upwardly" and downwardly"; "upstream" and "downstream"; "above" and "below"; and other like terms indicating relative positions above or below a given point or element are used in this description to more clearly describe some embodiments of the invention. However, when applied to equipment and methods for use in environments that are deviated or horizontal, such terms may refer to a left to right, right to left, or other relationship as appropriate.

In general, systems and techniques are disclosed herein for purposes of performing stimulation operations (fracturing operations, acidizing operations, etc.) in multiple zones, or stages, of a well using tools and objects (activation balls, darts or spheres, for example) that are communicated downhole through a tubing string to operate these tools. As disclosed herein, these tools may be independently selectively activated via perforating operations to place the tools in object catching states.

Figure 1:
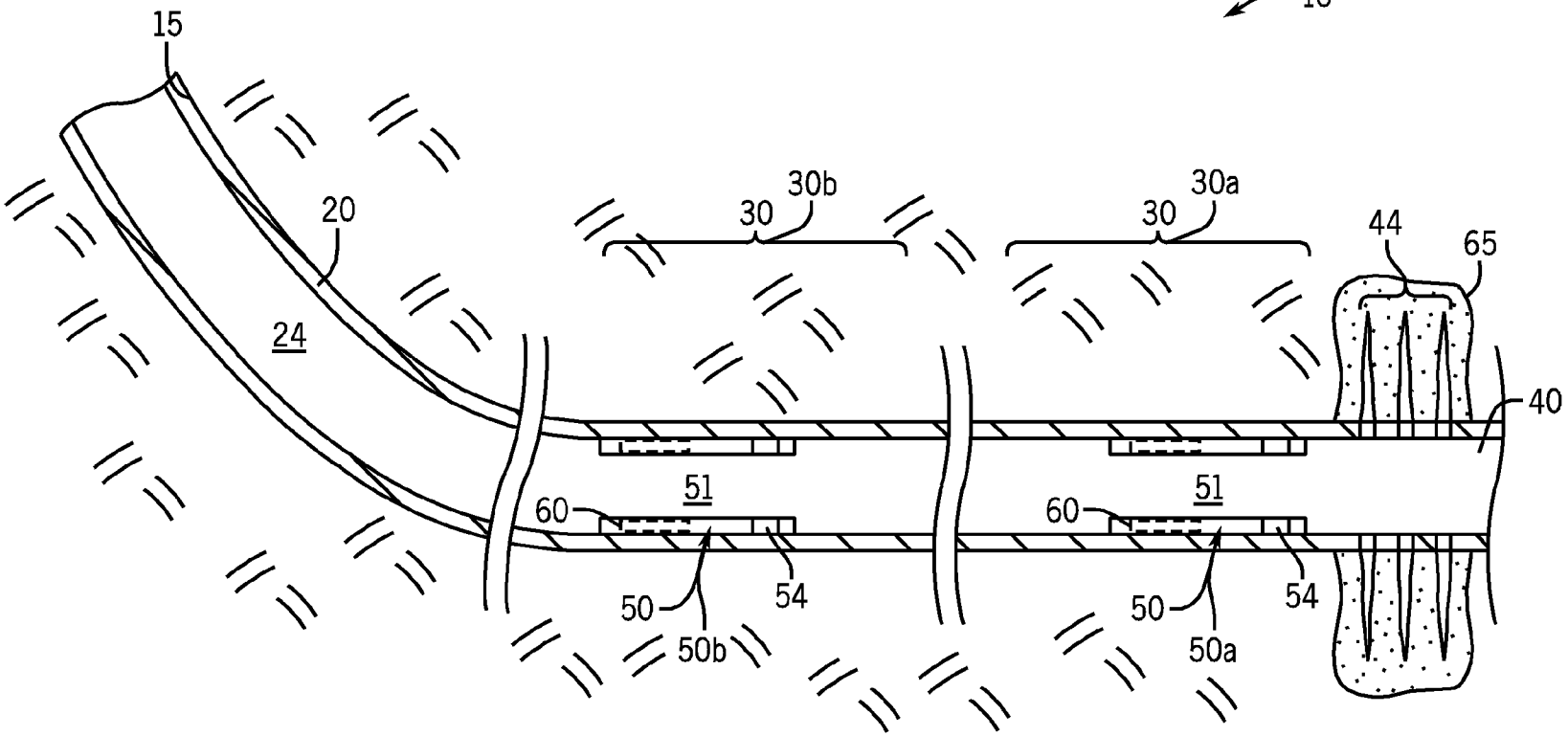
FIGS. 1, 2, 3, 4A and 5 are schematic diagrams of a well, which illustrate different states of a multi-stage completion system that includes tools that are selectively placed in object catching states using perforating according to embodiments of the invention.

Referring to FIG. 1, as a non-limiting example, in accordance with some embodiments of the invention, a well 10 includes a wellbore 15, which traverses one or more producing formations. For the non-limiting examples that are disclosed herein, the wellbore 15 is lined, or supported, by a tubing string 20, as depicted in FIG. 1. The tubing string 20 may be cemented to the wellbore 15 (such wellbores are typically referred to as "cased hole" wellbores), or the tubing string 20 may be secured to the formation by packers (such wellbores are typically referred to as "open hole" wellbores). In general, the wellbore 15 extends through one or multiple zones, or stages 30 (two exemplary stages 30*a* and 30*b* being depicted in FIG. 1, as non-limiting examples), of the well 10. For purposes of performing multi-stage simulation operations (fracturing operations, acidizing operations, etc.) in the well 10, the tubing string 20 includes tubing-deployed tools 50 (exemplary tools 50*a* and 50*b*, being depicted in FIG. 1), which allow the various stages 30 of the well 10 to be selectively pressurized as part of these operations. As depicted in FIG. 1, each tool 50 is concentric with the tubing string 20, forms a section of the tubing string 20 and in general, has a central passageway 51 that forms part of an overall central passageway 24 of the tubing string 20.

It is noted that although FIG. 1 and the subsequent figures depict a lateral wellbore 15, the techniques and systems that are disclosed herein may likewise be applied to vertical wellbores. Moreover, in accordance with some embodiments of the invention, the well 10 may contain multiple wellbores, which contain similar strings with similar tools 50. Thus, many variations are contemplated and are within the scope of the appended claims.

Figure 4A:
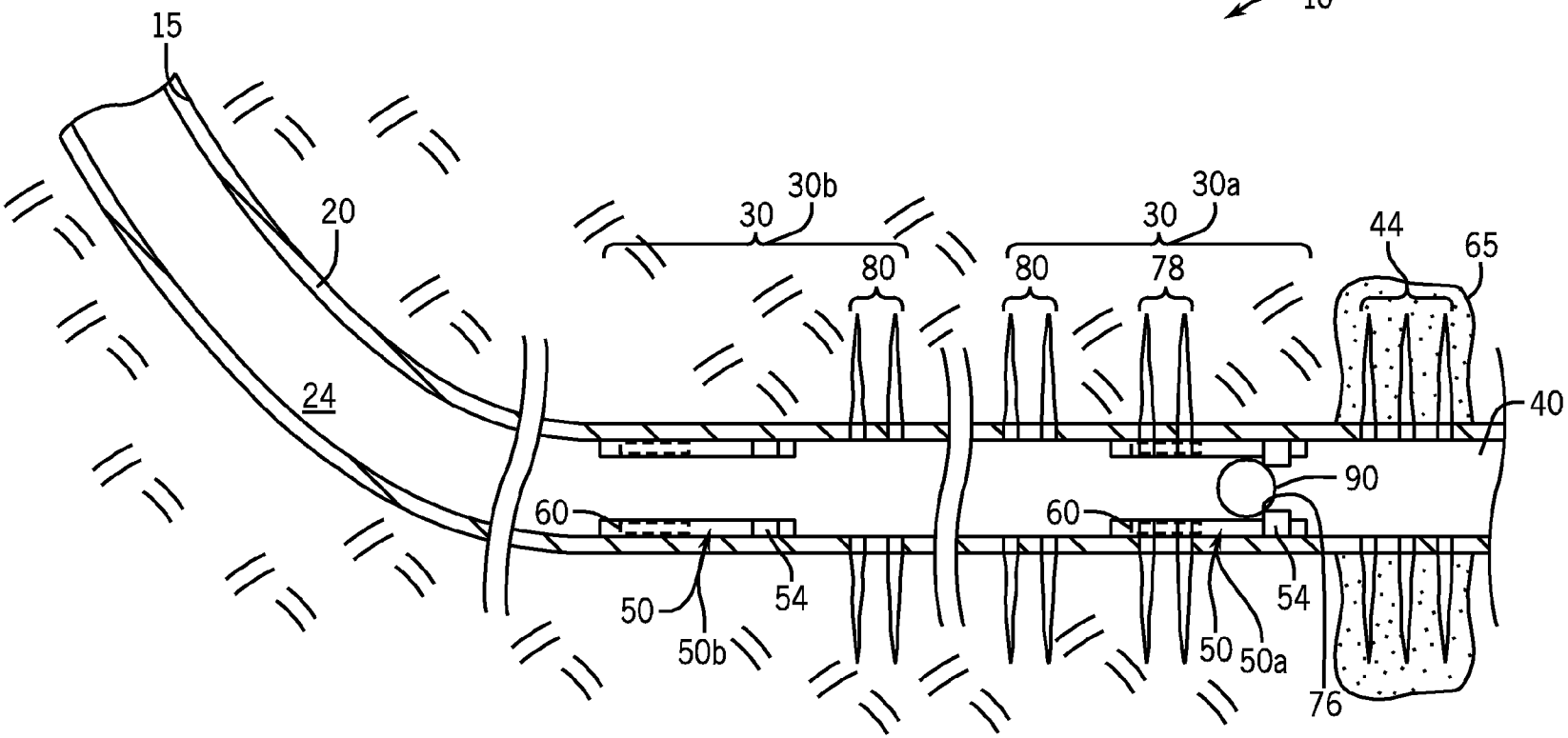
Figure 4B:
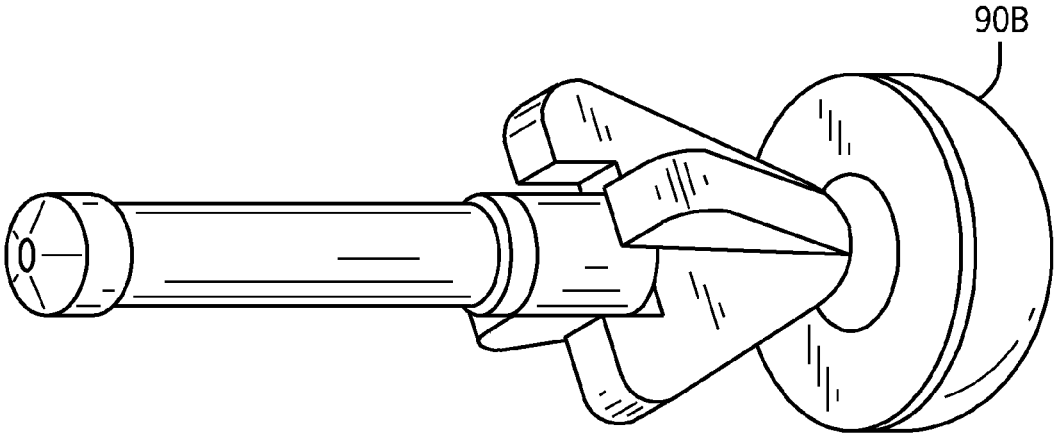
FIG. 4B shows an alternative object which may be used with embodiments of the invention.

In accordance with some embodiments of the invention, when initially deployed as part of the tubing string 20, all of the tools 50 are in their run-in-hole, deactivated states. In its deactivated state (called the "pass through state" herein), the tool 50 allows an object dropped from the surface of the wellbore (such as activation ball 90 that is depicted in FIG. 4A, for example or a dart 90B as shown in FIG. 4B) to pass through the central passageway 51 of the tool 50. As disclosed herein, each tool 50 may subsequently be selectively activated to place the tool 50 in an object catching state, a state in which tool 50 is configured to catch an object that is communicated to the tool 50 via the central passageway 24 of the tubing string 20. In its object catching state, the tool 50 restricts the passageway 51 to form a seat to catch the object (as depicted in FIG. 4 or 4B, for example).

More specifically, a given tool 50 may be targeted in the sense that it may be desired to operate this targeted tool for purposes of performing a stimulation operation in a given stage 30. The tool 50 that is targeted is placed in the object catching state so that an object that is deployed through the central passageway 24 (from the surface of the well 10 or from another downhole tool) may travel to the tool and become lodged in the object catching seat that is formed in the tool 50. The seat and the object caught by the seat then combine to form a fluid tight barrier. This fluid tight barrier may then be used, as further described herein, for purposes of directing a pressured fluid into the well formation.

Turning now to the more specific details, in general, each tool 50 includes a seat forming element 54, which is constructed to, when the tool 50 is activated, radially retract to form an object catching seat (not shown in FIG. 1) inside the passageway 51 to transition the tool 50 from a pass through state to an object catching state. As further described herein, in accordance with some embodiments of the invention, the seat forming element 54 may be an element such as a C ring or a collet (as non-limiting examples) that may be compressed to form the object catching seat.

In accordance with some embodiments of the invention, one way to activate the tool 50 is to perforate a chamber 60 (of the tool 50) which generally surrounds the passageway 51 and in at least some embodiments, is disposed uphole of the seat forming element 54. In this manner, the chamber 60 is constructed to be breached by, for example, at least one perforating jet that is fired from a perforating gun (not depicted in FIG. 1); and as further described herein, the tool 50 is constructed to automatically respond to the breaching of the chamber 60 to cause the tool 50 to automatically contract the seat forming element 54 to form the object catching seat.

Initially, the chamber 60 is filled with a gas charge that exerts a pressure that is different than the pressure of the downhole environment. The pressure exerted by this gas charge retains the tool 50 in its pass through state. However, when the chamber 60 is breached (by a perforating jet, for example), the tool responds to the new pressure (a higher pressure, for example) to radially retract the seat forming element 54 to form the object catching seat.

As a non-limiting example, in accordance with some implementations, chamber 60 is an atmospheric chamber that is initially filled with a gas that exerts a fluid pressure at or near atmospheric pressure. When the chamber 60 is breached, the higher pressure of the well environment causes the tool 50 to compress the seat forming element 54.

For purposes of example, one tool 50 is depicted for each stage 30 in FIG. 1. However, it is understood that a given stage 30 may include multiple tools 50, in accordance with other implementations. In addition, although only two tools 50 are depicted in FIG. 1, forty or fifty such tools 50, and in fact, an unlimited number of such tools 50 are contemplated in order to effect stimulation operations in a correspondingly unlimited number of stages or zones in the wellbore formation. Furthermore, for the examples that are disclosed herein, string 20 and the surrounding formation at a toe end 40 of the wellbore 15 may be perforated, resulting in a corresponding set 44 of perforation tunnels, and stimulated resulting in stimulated region 65 by tools 50 not shown in FIG. 1.

In the following examples, it is assumed that the stimulation operations are conducted in a direction from the toe end to the heel end of the wellbore 15. However, it is understood that in other embodiments of the invention, the stimulation operations may be performed in a different direction and may be performed, in general, at any given stage 30 in no particular directional order.

Figure 2:
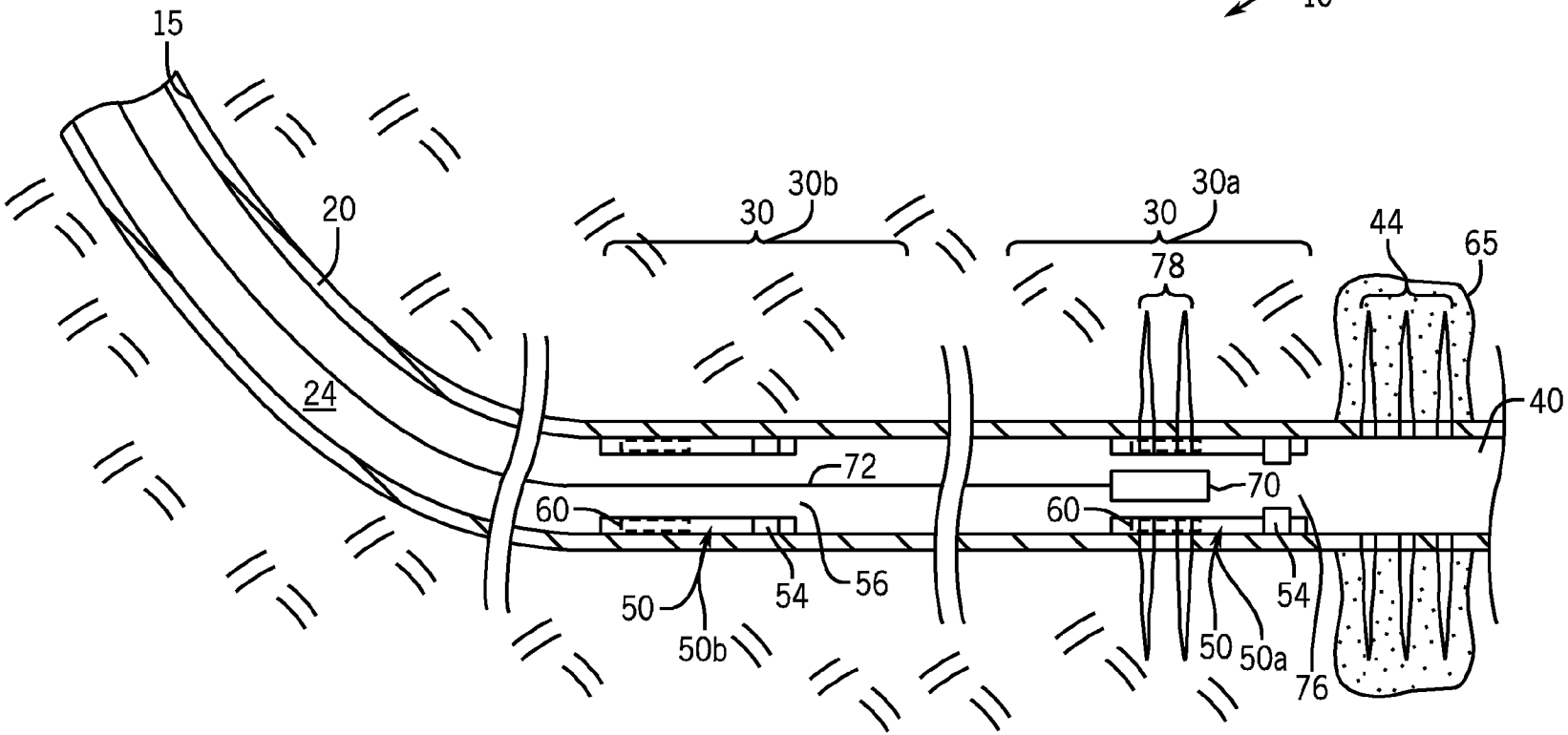

Referring to FIG. 2, in accordance with some embodiments of the invention, the lowermost tool 50*a* may first be activated by running a perforating gun 70 (via a wireline 72 or other conveyance mechanism) into the central passageway 24 of the tubing string 20 to the appropriate position to perforate the chamber 60 of the tool 50*a*. As can be appreciated by the skilled artisan, any of a number of techniques may be used to ensure that the perforating is aligned with a designated region of the tool 50*a* so that at least one perforating jet that is produced by the firing of the gun 70 breaches the chamber 60 of the tool 50*a*. Note that this perforating operation to breach the chamber 60 may also result in perforations being created in the adjacent portion of the tubing 20 and into the surrounding formation to form a set of perforation tunnels 78, as depicted in FIG. 2. Alternatively, the chamber 60 may be perforated by a tool that is run downhole (on a coiled tubing string, for example) inside the central passageway 24 of the tubing string 20, and positioned inside the tool 50*a* to deliver an abrasive slurry (pumped through the coiled tubing string, for example) to abrade a wall of the chamber 60 to thereby breach the chamber 60.

The tool 50*a* responds to the breaching of the chamber 60 by automatically radially contracting the seat forming element 54 to place the tubing tool 50*a* in the object catching state. As depicted in FIG. 2, in the object catching state, the radially contracted seat element 54 forms a corresponding seat 76 that is sized appropriately to catch an object communicated downhole through the central passageway 24 of the tubing string 20 so that the communicated object lodges in the seat 76. Moreover, the seat 76 is constructed to, in conjunction with the object lodged in the seat 76, create a fluid tight barrier, preventing fluid from progressing therepast and further down the central passageway 24 of the tubing string 20.

Figure 3:
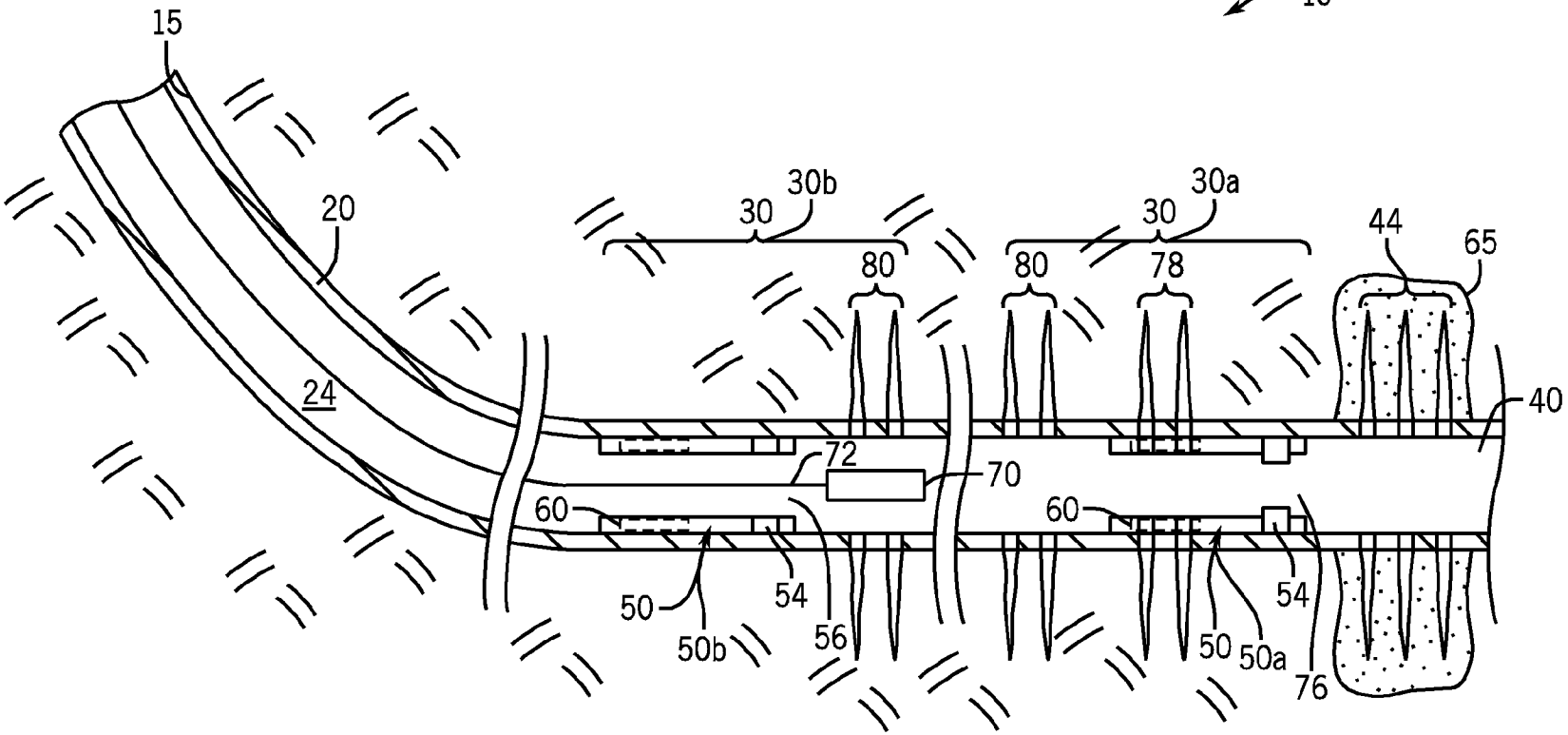

Referring to FIG. 3, in one embodiment before the object is communicated downhole, however, the perforating gun 70 is pulled uphole from the tool 50*a* to perforate the tubing string 20 at least at one other location to create at least one additional set 80 of perforation tunnels. In this regard, the tubing string 20 and surrounding formation are selectively perforated between the tool 50*a* and the next tool 50*b* above the tool 50*a* to further increase hydraulic communication between the central passageway 24 of the tubing string 20 and the surrounding formation. Alternatively, in other embodiments of the invention, the perforating gun 70 may be replaced by a tool that is run downhole (on a coiled tubing string, for example) inside the central passageway 24 to deliver an abrasive slurry to form openings in the wall of the tubing string 20 and open fluid communication paths to the formation, which are similar to the perforation tunnels 80. After the additional perforating operation(s) are completed, the perforating gun 70 is pulled out of the well 10 to create a free passageway to deploy a dropped object, such as an activation ball 90 that lodges in the seat 76, as depicted in FIG. 4A.

Figure 5:
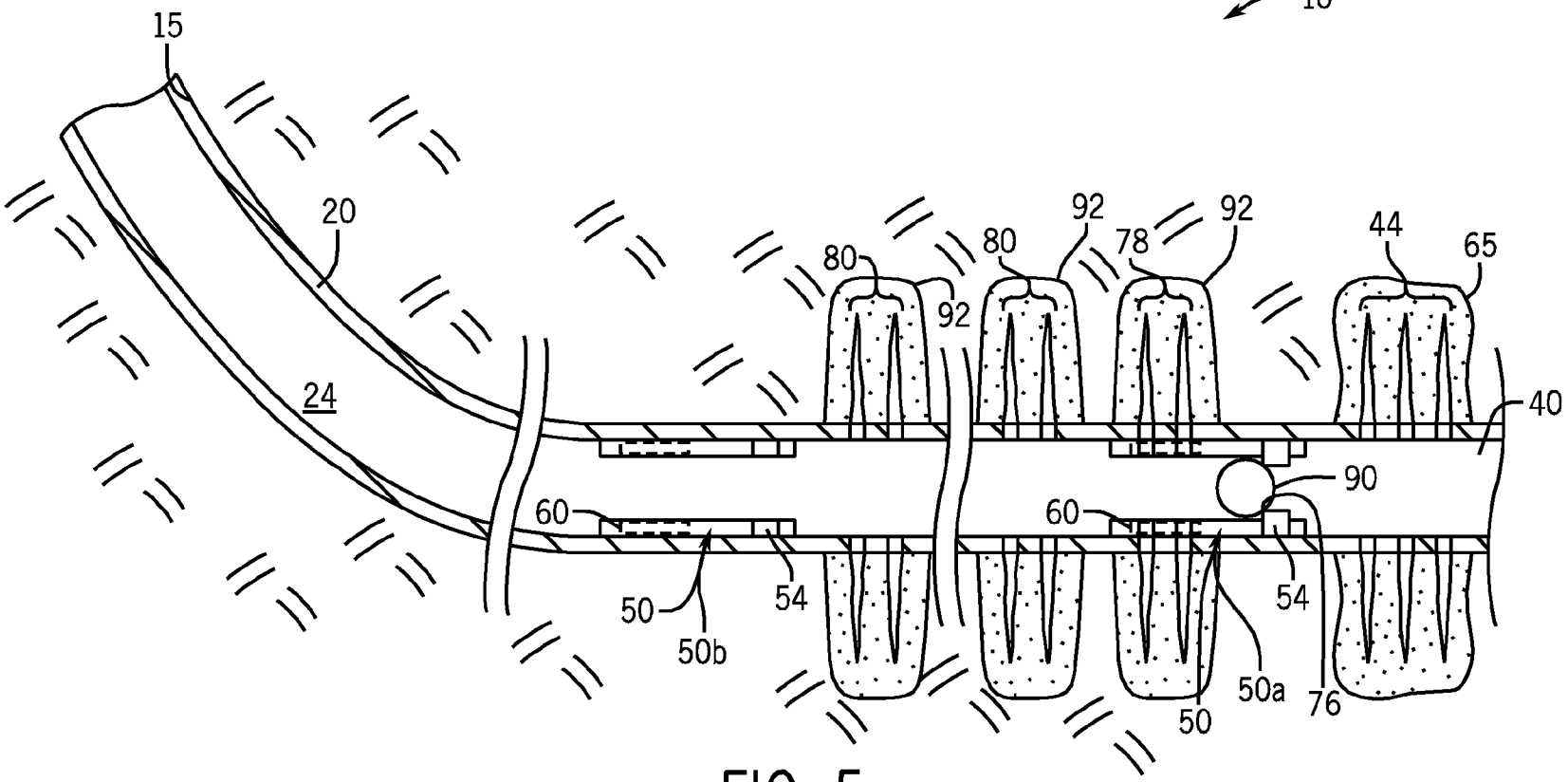

Referring to FIG. 4A, for this example, the activation ball 90 is communicated downhole from the Earth surface of the well through the central passageway 24 of the tubing string 20. This ball 90 passes through the other tools 50 (such as the tool 50*b* depicted in FIG. 4A), which are located uphole of the tool 50*a*, as these other tools 50 are in their initial, pass through states. Due to the landing of the object 90 in the seat 76, a fluid tight barrier is created in the tubing string 24 at the tool 50*a*. Therefore, a stimulation fluid may be communicated into the central passageway of the tubing string 24 and pressurized (via surface-disposed fluid pumps, for example) to perform a stimulation operation. That is, the stimulation fluid pumped through the central passageway 24 of the tubing string 20 is stopped from progressing down the central passageway 24 past the fluid tight barrier formed by the combination of the seat 76 and the ball 90, and instead the stimulation fluid is directed into the formation at the set of perforation tunnels 78 and 80 to create stimulated regions 92 in the formation as depicted in FIG. 5. In one example, the stimulation fluid is a fracturing fluid and the stimulated regions 92 are fracture regions. In another example, the stimulation fluid is an acid.

Thus, FIGS. 1-5 describe at least one way in which a given tool 50 may be selectively placed in an object catching state and used to perform a stimulation operation in a segment of the well 10 between a given tool 50 and the next adjacent, tool 50 that is disposed uphole of the given tool 50. Therefore, for this non-limiting example, the stimulation operations proceed uphole from the toe end 40 toward the heel of the wellbore 15 by repeating the above-described operations for the other tools 50.

Figure 6:
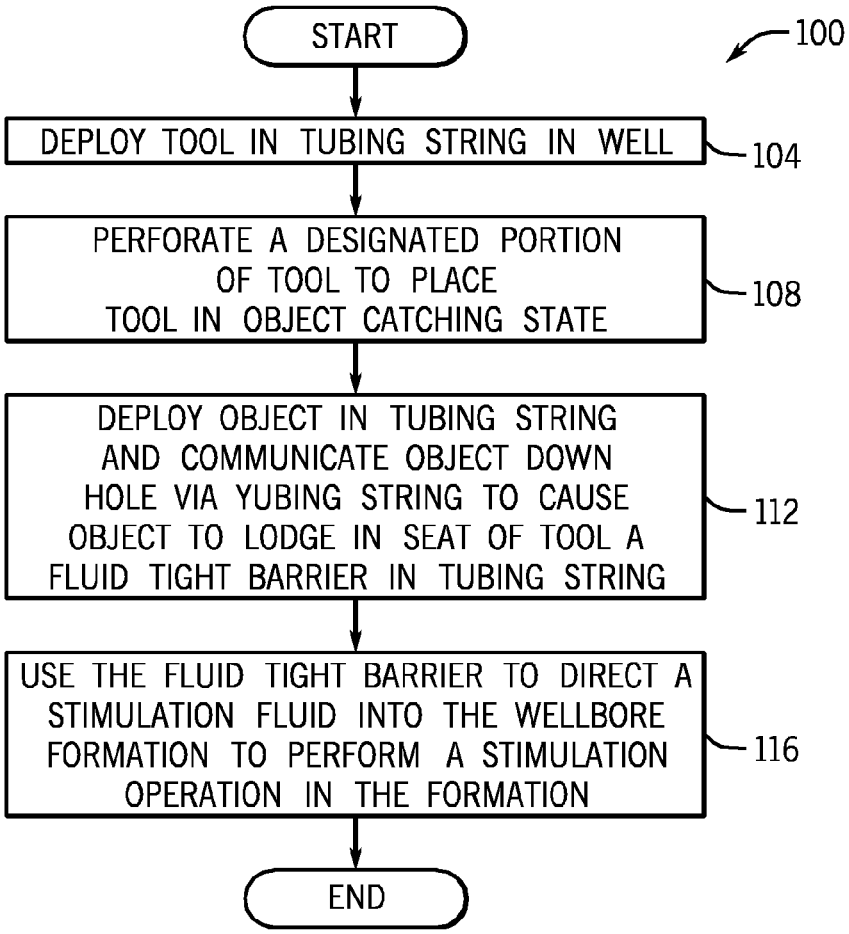
FIG. 6 is a flow diagram depicting a technique to use tools that are selectively placed in object catching states by perforating to perform a multi-stage completion operation according to embodiments of the invention.

Referring to FIG. 6, therefore, in accordance with some embodiments of the invention, a technique 100 includes deploying (block 104) a tool in a tubing string in a well and perforating (block 108) a designated portion of the tool to place the tool in an object catching state. The technique 100 includes deploying (block 112) an object, such as an activation ball or a dart (as non-limiting examples) in the tubing string and communicating the object downhole via the tubing string to cause the object to lodge in a seat of the tool to create a fluid tight barrier in the tubing string. This fluid tight barrier may then be used, pursuant to block 116, to block a stimulation fluid from further progressing through the central passageway of the tubing string and instead be directed into the wellbore formation to stimulate the formation. The technique 100 may be repeated for subsequent stimulation operations using other such tools in the well, in accordance with the various embodiments of the invention.

Figure 7:
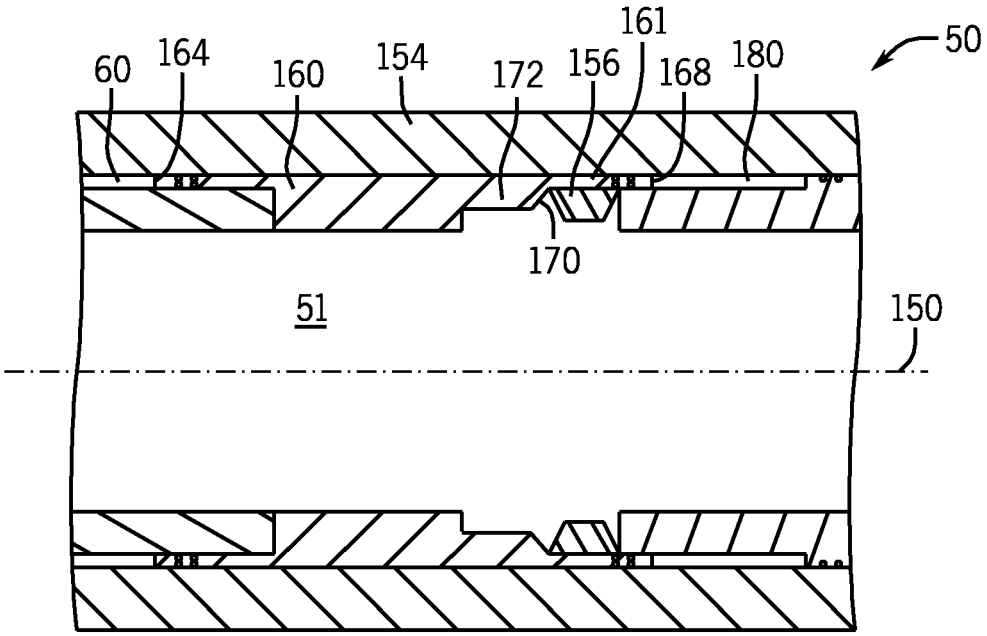
FIGS. 7 and 8 are schematic diagrams of the tool of FIGS. 1-5 in different states according to embodiments of the invention.

Referring to FIG. 7, in accordance with some embodiments of the invention, the tool 50 may include a tubular housing 154 that generally circumscribes a longitudinal axis 150 of the tool 50 and forms a section of the tubing string 20. For this non-limiting example, the seat forming element 54 (see FIG. 4A, for example) is a C ring 156, which in its relatively uncompressed state (as shown in FIG. 7) allows objects to pass through the central passageway 51 of the tool 50. The C-ring 156 is selectively compressed using an operator mandrel 160, in accordance with some embodiments of the invention. In this manner, the operator mandrel 160 is biased to maintain the C-ring 156 in its uncompressed state, as depicted in FIG. 7, as long as the chamber 60 has not been breached. In accordance with some embodiments of the invention, the chamber 60 exerts atmospheric pressure on one end 164 of the operator mandrel 160; and the force that is exerted by the chamber 60 is balanced by the force that is exerted on another end 168 of the mandrel 160 by, for example, another atmospheric chamber 180. As long as the chamber 60 remains unbreached, the C-ring 156 is surrounded by a radially thinner section 161 of the operator mandrel 160 and remains relatively uncompressed.

Figure 8:
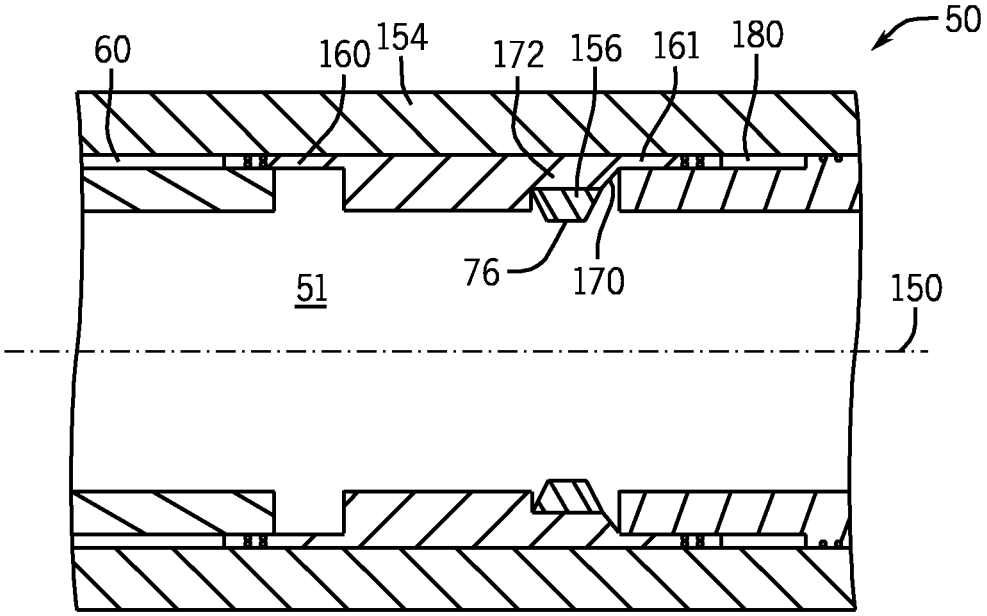

As depicted in FIG. 7, in accordance with some implementations, the thinner section 161 may be part of a radially graduated profile of the operator mandrel 160. The graduated profile also contains a radially thicker portion 172 to compress the C ring 156 and a beveled surface 170 that forms a transition between the thinner 161 and thicker 172 sections. A breach of the chamber 60 produces a differential force across the operator mandrel 160 to force the thicker portion 172 to surround the C-ring 156, thereby compressing the C-ring 156 to form the object catching seat 76, which may now take on the form of a radially reduced O-ring shape, as depicted in FIG. 8.

Figure 9:
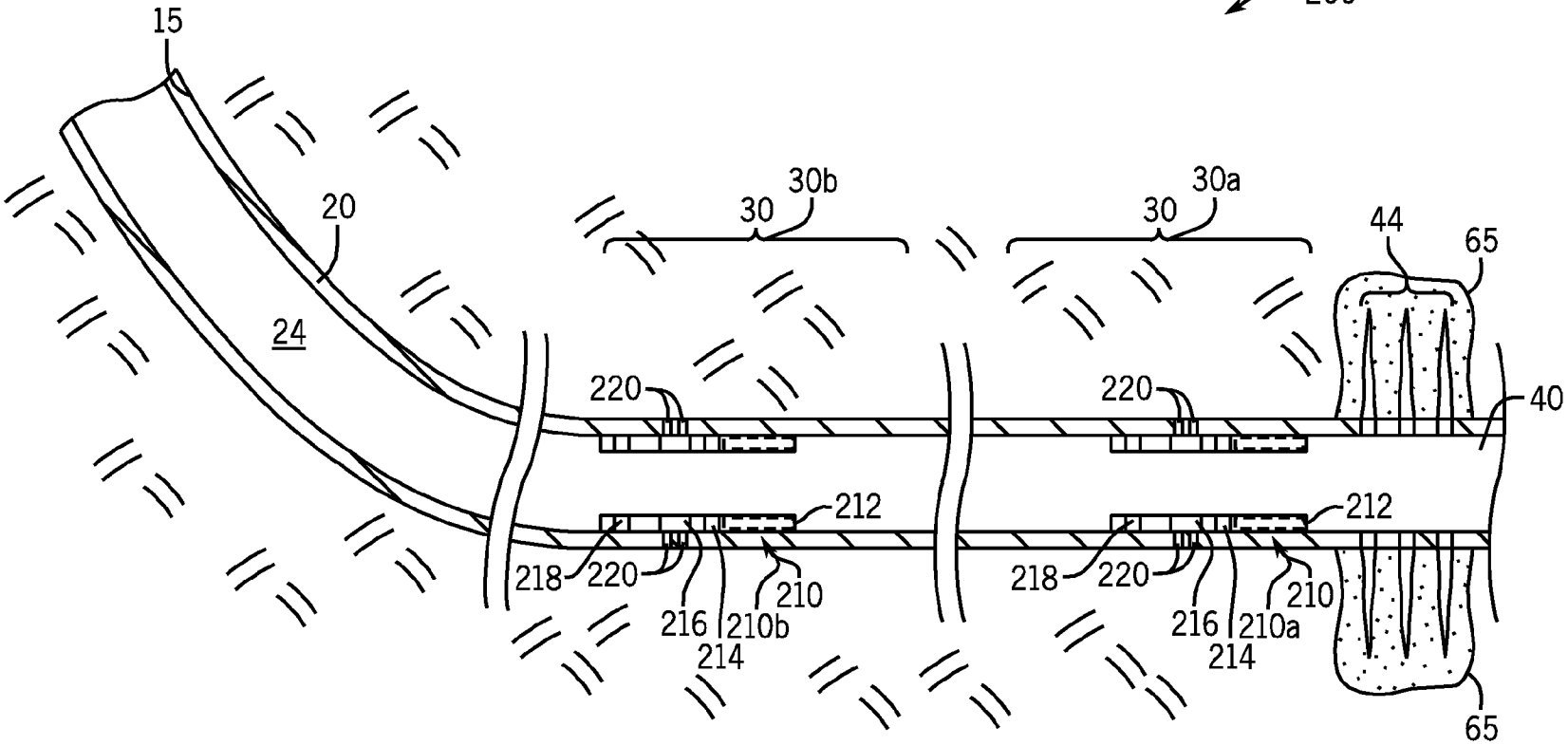
FIGS. 9, 10, 11, 12, 13 and 14 are schematic diagrams of a well illustrating different states of a multi-stage completion system that includes valve tools according to other embodiments of the invention.

Referring to FIG. 9, in accordance with other embodiments of the invention, a well 200 may use tubing-deployed valve tools 210 (in place of the tools 50), which contain objected-operated tubing valves 216. In general, FIG. 9 contains similar references corresponding to similar elements discussed above, with the different elements being represented by different reference numerals. The tubing valves 216 may be selectively operated to selectively establish communication between the central passageway 24 of the tubing string 20 and the surrounding formation. In this regard, the tubing valve 216, when open, permits fluid communication through a set of radial ports 220 that are forming in the tubing string 20.

Similar to the tool 50, the tool 210 includes a chamber 212 (an atmospheric chamber, for example), which is constructed to be selectively breached by perforating for purposes of transitioning the tool 210 into an object catching state. However, unlike the tool 50, the tool 210 has two seat forming elements 214 and 218: The seat element 214 is activated, or radially contracted, to form a corresponding seat for catching an object to operate the tubing valve 216 in response to the perforation of the chamber 212; and the seat element 218 is activated, or radially contracted, to form a corresponding valve seat for catching another object in response to the opening of the tubing valve 216, as further described below. As depicted in FIG. 9, unlike the chamber 60 of the tool 50 (see FIG. 1, for example), which is located above, or uphole, from the seat elements 54, the chamber 212 is located below, or downhole from, the seat forming elements 214 and 218. Similar to the seat forming element 54 of the tool 50, the seat forming element 214, 218 may, in accordance with some embodiments of the invention, be formed from a compressible element (such as a collet or a C ring, as non limited examples) that when radially compressed, forms a seat for catching an object.

More specifically, when the tubing tools 210 are initially installed as part of the tubing string 20, all of the tubing tools 210 are in their object pass through states. In other words, the seat forming elements 214 and 218 of each tubing tool 210 are initially in a position to allow objects (such as balls or darts) to pass through the tools 210.

Figure 10:
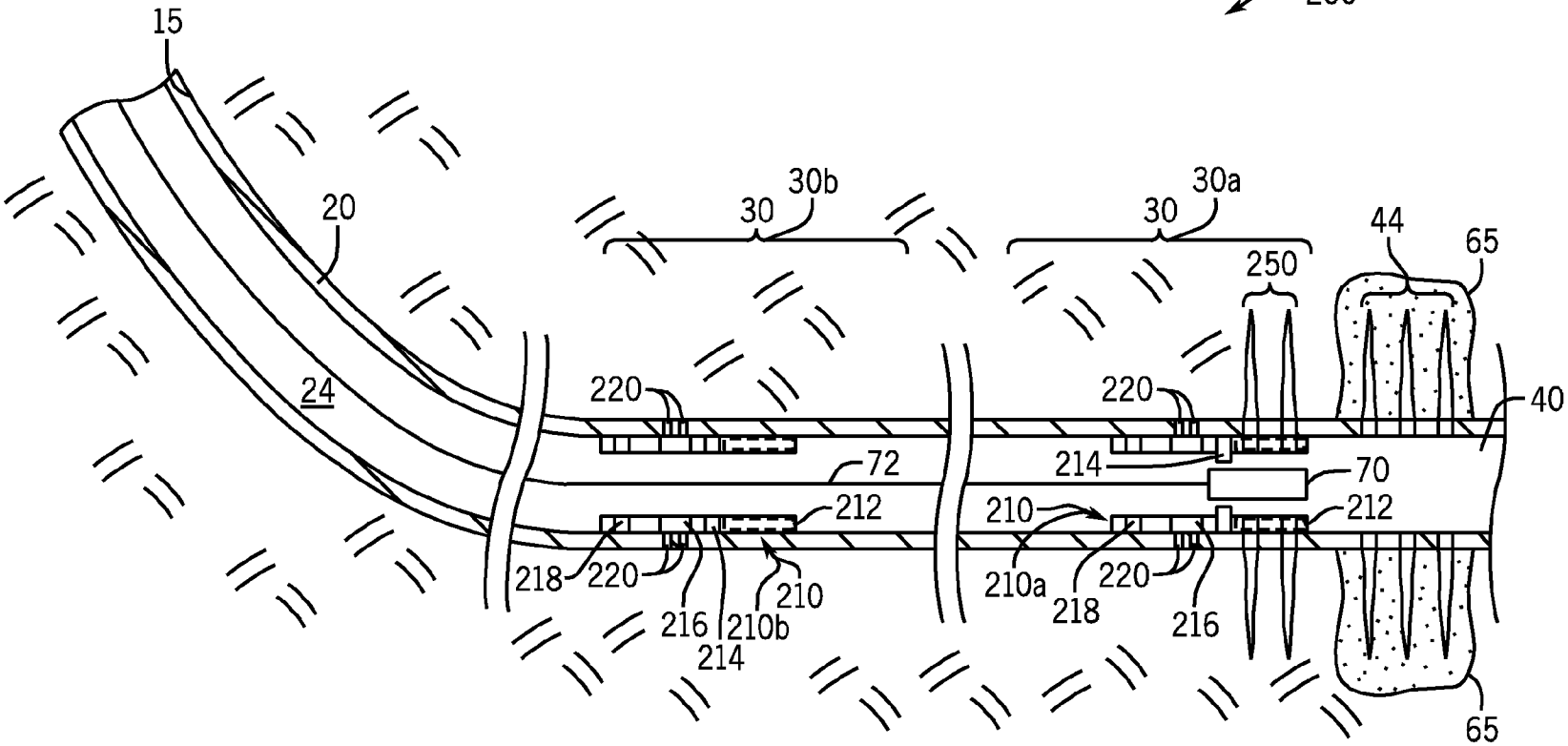
Figure 11:
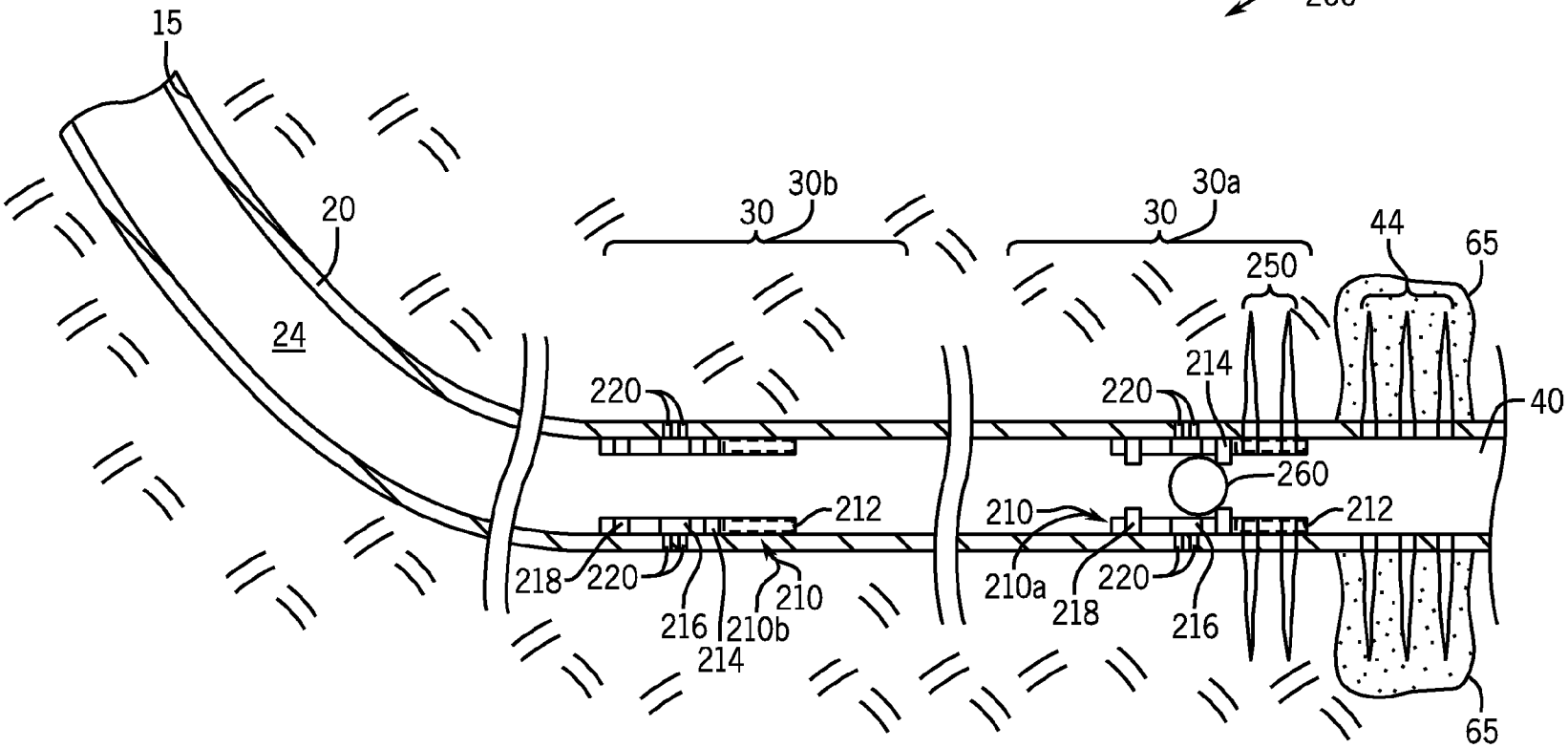

FIG. 10 depicts the well 200 at the beginning of a stimulation operation in the stage 30*a* nearest to the toe end 40 of the wellbore 15. As depicted in FIG. 10, a perforating gun 70 is selectively positioned to form at least one perforating jet that breaches the chamber 212 of the tool 210*a*. Thus, FIG. 10 depicts a set 250 of perforation tunnels formed from perforating jets, and at least one of the perforating jets breaches the chamber 212 of the tool 210*a*. Similar to the above-described operation of the tool 50, the tool 210 is constructed to automatically respond to the breaching of the chamber 212 to radially contract the seat forming element 214 to form an object catching seat for the tool 210, as depicted in FIG. 10. Thus, referring to FIG. 11, an object, such as an activation ball 260 or a dart, may be communicated downhole through the central passageway 24 of the tubing string 20 to land in this seat created by the radially contracted seat forming element 214 to create a corresponding fluid tight barrier in the central passageway 24 of the tubing string 20.

Figure 12:
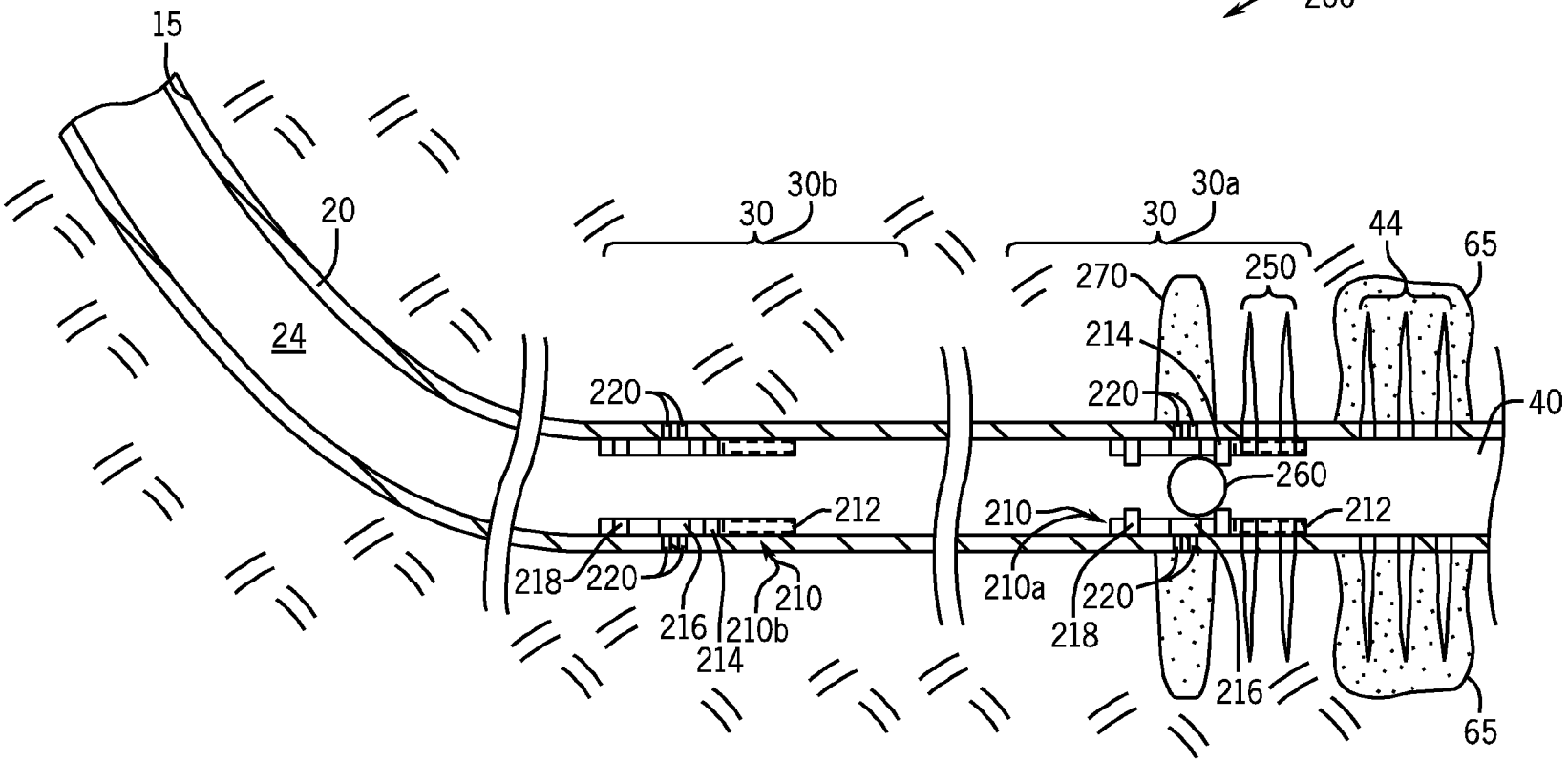

Due to this fluid tight barrier, fluid may be pressurized uphole of the seated activation ball 260, and the seat forming element 214 is constructed to translate downhole when this pressure exceeds a predetermined threshold. The resultant longitudinal shifting of the seat forming element 214, in turn, causes the tubing valve 216 to shift downwardly to thereby permit fluid communication with the reservoir, as depicted in FIG. 12. Therefore, pressurization of the fluid uphole of the ball 260 opens the valve 216 and may be used to, as a non-limiting example, perform a stimulation operation. For the example that is depicted in FIG. 12, this stimulation operation involves hydraulically fracturing the formation surrounding the ports 220 to create corresponding fractured regions 270. Alternatively an acid may be used to stimulate the regions 270.

As also depicted in FIG. 12, the shifting of the seat element 214 not only opens the valve 216 but also transitions the other seat forming element 218 (that is disposed uphole from the seat forming element 214) into its object catching state. In other words, as depicted in FIG. 12, due to the shifting of the element 214, the seat forming element 218 radially contracts to thereby form a corresponding seat to catch another object.

Figure 13:
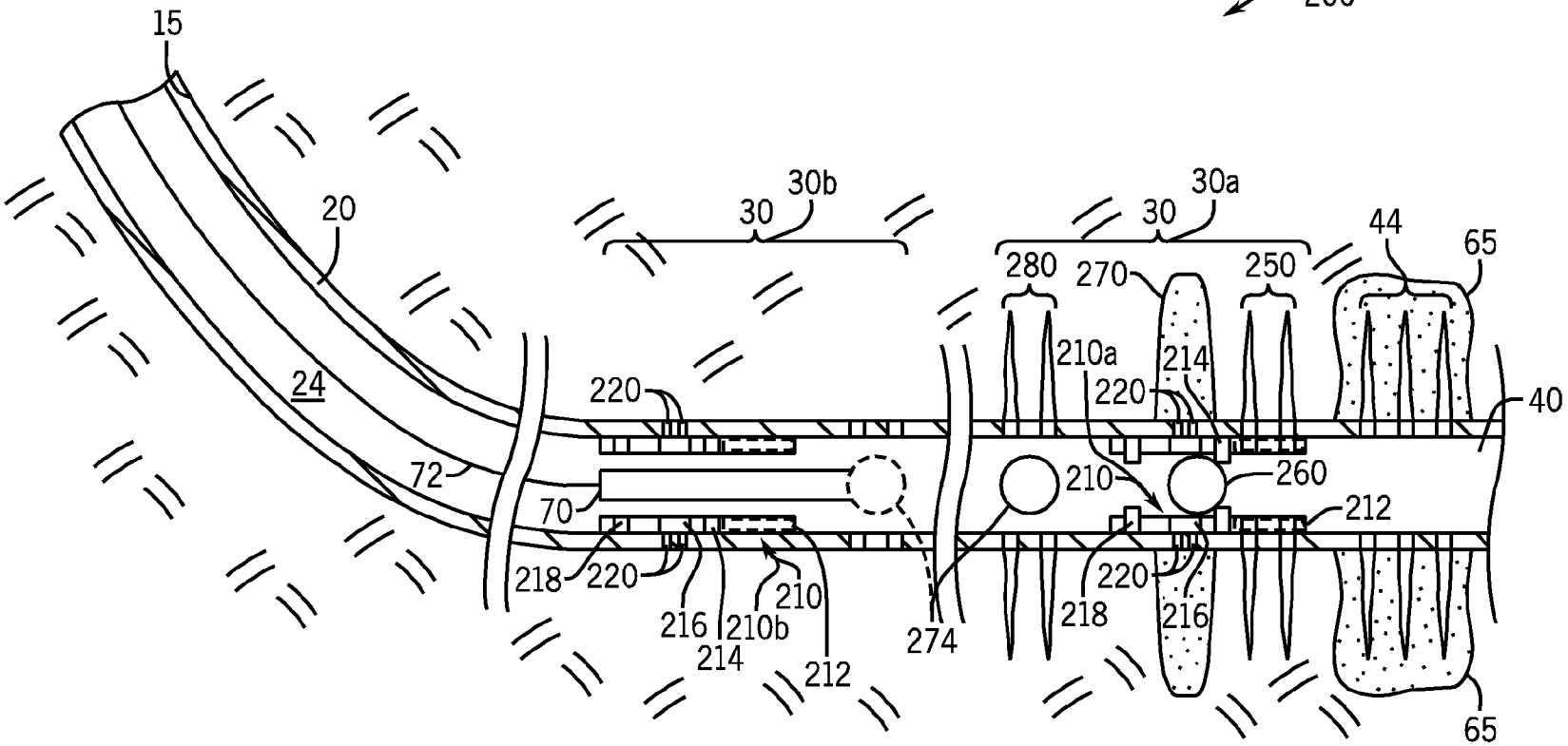
Figure 14:
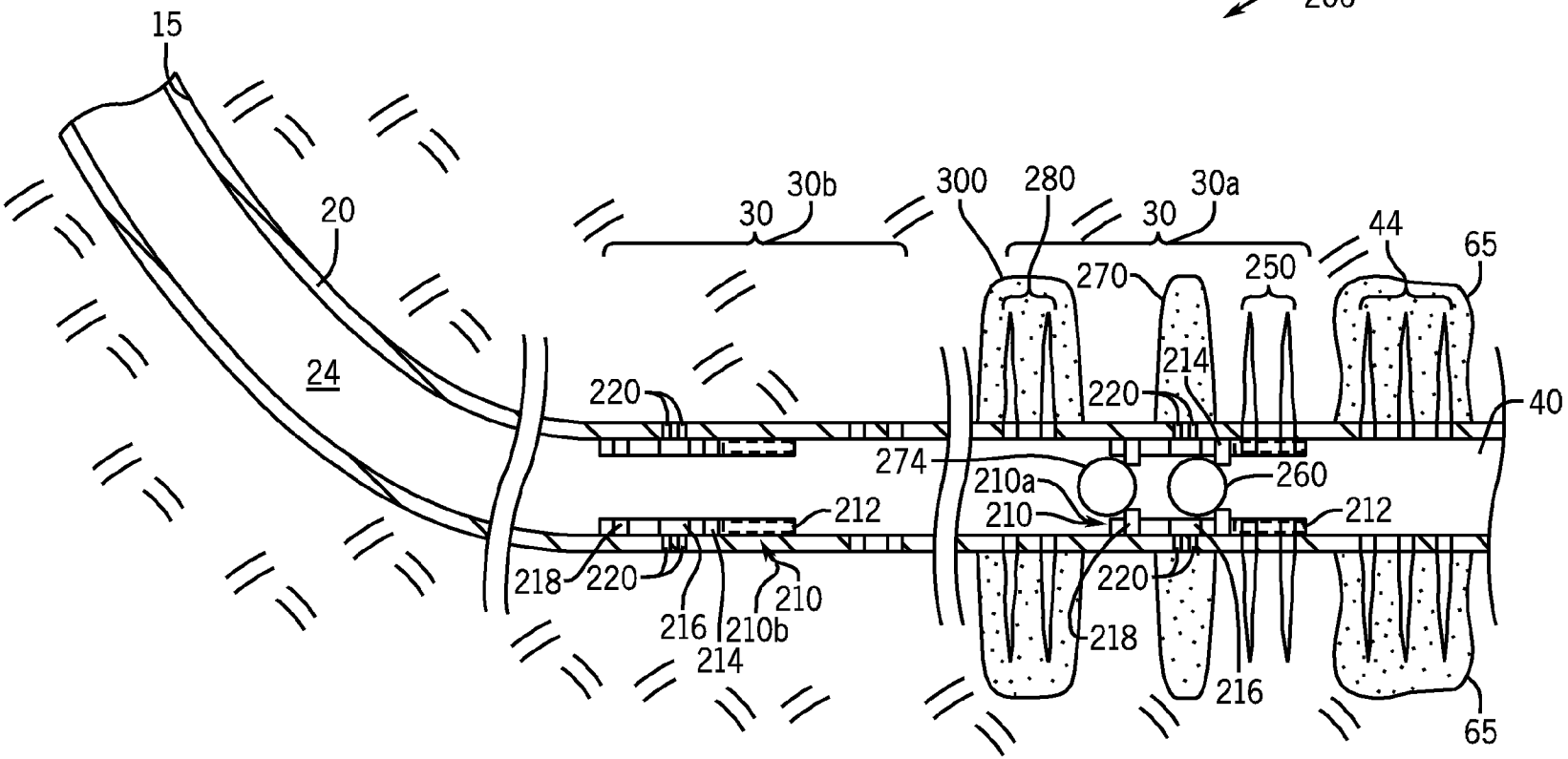

As a more specific example, FIG. 13 depicts the use of a perforating gun 70, in a subsequent run into the well 200, for purposes of creating one or more sets 280 of perforation tunnels 280 between the tools 210*a* and 210*b* and the use of the perforating gun 70 for purposes of conveying another activation ball 274 downhole. In this regard, as depicted in FIG. 13, the activation ball 274 may be initially attached to the lower end of the perforating gun 70, as depicted by the dashed line in FIG. 13. At the end of the perforating operation that creates the corresponding set(s) 280 of perforation tunnels, the perforating gun 70 is controlled from the surface of the well 200 in a manner that causes the gun 270 to release of the activation ball 274. After being released, the activation ball 274 travels farther downhole to lodge in the seat that is formed by the element 218, as depicted in FIG. 14. Note that the gun may be used to convey an object 90 down the well in the previously described embodiments of the invention as well.

Referring to FIG. 14, due to the lodging of the activation ball 274 in the seat created by the seat forming element 218, another fluid tight barrier in the tubing string 20 is created to allow a stimulation operation to be performed uphole of the ball 274. In this manner, as depicted in FIG. 14, a fracturing or acidizing operation, for example, may be performed to form one or more stimulated regions 300 in the formation. The other stages (such as the stage 30*b*) may be stimulated in a similar manner, in accordance with the various potential embodiments of the invention.

Figure 15:
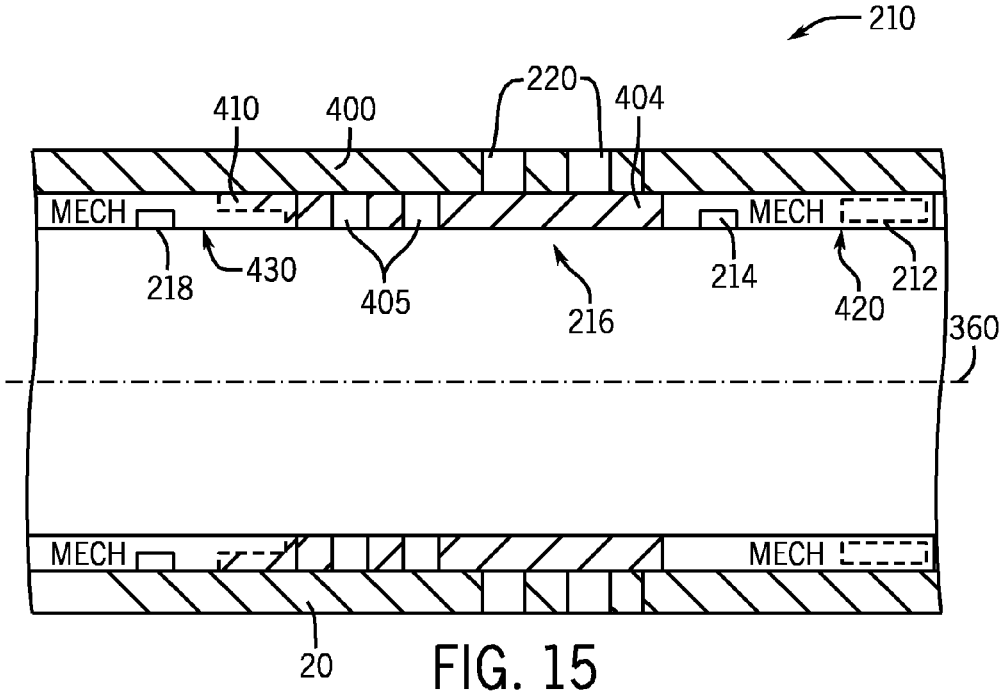
FIG. 15 is a schematic diagram of the valve tool of FIGS. 9-14 according to an embodiment of the invention.

As a non-limiting example, FIG. 15 generally depicts the tool 210 in accordance with some implementations. For this example, the tool 210 includes a tubular housing 400 that generally circumscribes a longitudinal axis 360 of the tool 210 and forms a section of the tubing string 20. The housing contains radial ports 220 that form part of the valve 216. In this manner, the valve 216, for this example, is a sleeve valve that contains an inner sleeve 404 that contains radial ports 405 and is constructed to slide along the longitudinal axis with respect to the housing 400. When the valve 216 is open, the sleeve 404 is in a position in which the radial ports 405 of the sleeve 404 align with the ports 220, and when the 220 when the valve 216 is closed (as depicted in FIG. 15), the sleeve 404 is in a position in which fluid communication through the ports 220 and 405 is blocked. Not shown in FIG. 15 are various seals (o-rings, for example) between the outer surface of the sleeve 404 and the inner surface of the housing 400.

When initially installed as part of the tubing string 20, the valve 216 is closed, as depicted in FIG. 15. For purposes of allowing the valve 216 to be opened, the valve 216 is attached to a mechanism 420, which is schematically depicted in FIG. 15. Similar to the above-described actuating mechanism to compress the seal element 54 of the tool 50, the mechanism 420 contains an operator mandrel that responds to the breaching of the chamber 212 to compress the seal forming element 214 to form an object catching seat. After an object is deployed that lodges in the seat, a downward force may then be exerted by fluid pressure in the tubing string 20 on the mechanism 420. Due to the attachment of the sleeve 404 to the mechanism, the downward force moves the sleeve 404 downwardly along the axis 360 until the sleeve 404 reaches a stop (not shown), and at this position, the ports 405 of the sleeve 404 align with the ports 220 of the housing 400 to place the valve 216 in it open state.

As schematically depicted in FIG. 15, an upper extension 410 of the sleeve 400 is attached to a mechanism 430 (schematically depicted in FIG. 15), which is attached to the housing 400. The downward movement of the sleeve 404 causes the extension 410 to move an operator mandrel of the mechanism 430 to compress the sealing forming element 218 to form an other object catching seat in a similar way that the above-described actuating operator mandrel 160 of the tool 50 compresses the seal element 54. Thus, the downward translation of the sleeve 404 along the longitudinal axis 360 opens the valve 216 and activates the second object catching seat of the tool 210.

Figure 16:
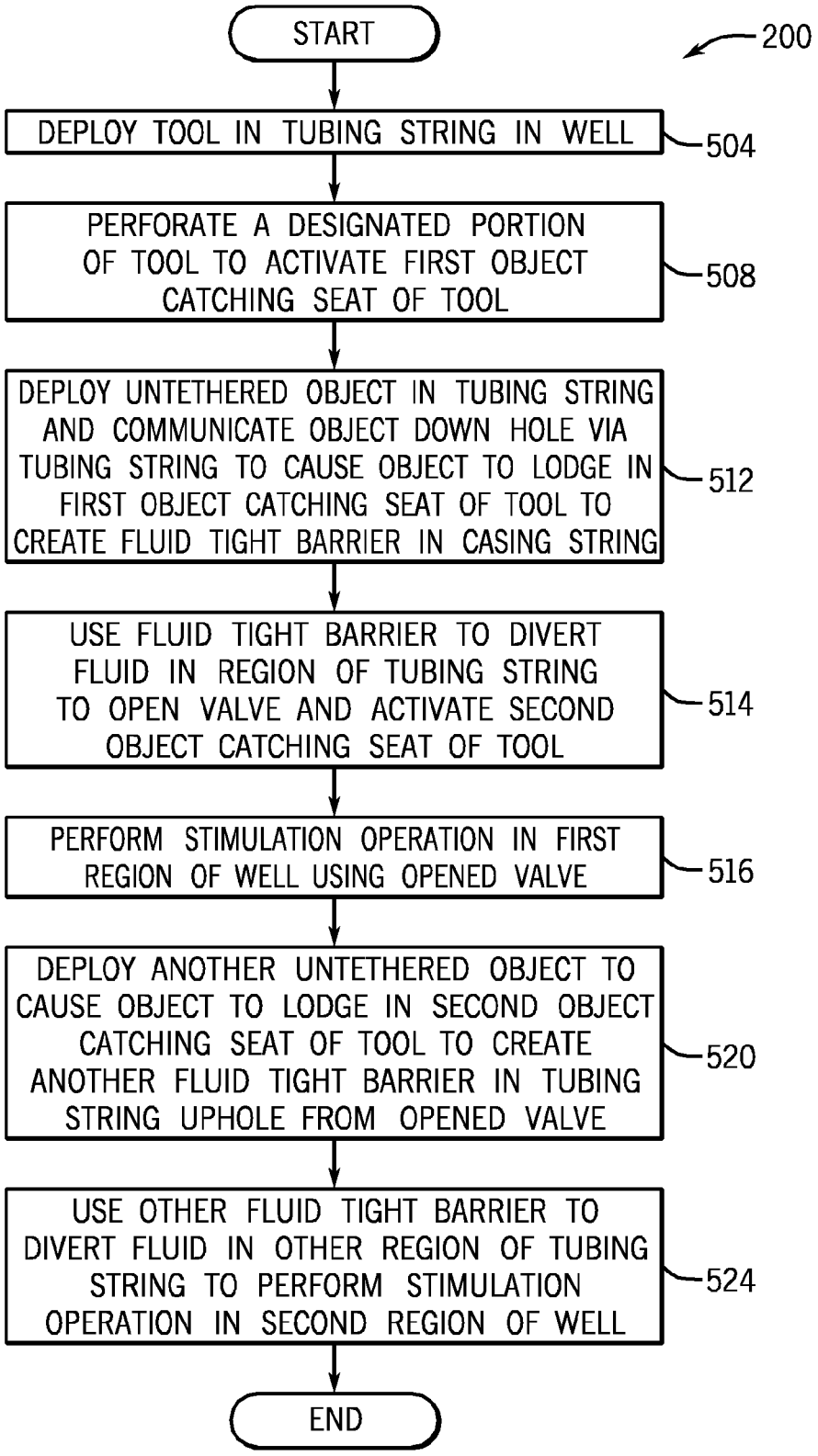
FIG. 16 depicts a flow chart illustrating a technique to use valve tools to perform a multi-stage completion operation according to embodiments of the invention.

Referring to FIG. 16, thus, a technique 500 in accordance with embodiments of the invention includes deploying (block 504) a tool in a tubing string in a well and perforating (block 508) a designated portion of the tool to activate a first object catching seat of the tool. Pursuant to the technique 500, an object is then deployed in the tubing string and communicated downhole via the tubing string to cause the object to lodge in a first object catching seat of the tool to create a fluid tight barrier in the tubing string, pursuant to block 512. The fluid tight barrier is then used (block 514) to pressurize a region of the tubing string to open a tubing valve and activate a second object catching seat of the tool. A stimulation operation may then be performed, pursuant to block 516, using the opened tubing valve in a first region of the well. The technique 500 further includes deploying (block 520) another object to cause the object to lodge in a second object catching seat of the tool to create another fluid tight barrier in the tubing string uphole from the open valve. This other fluid tight barrier is then used to pressurize a region of the tubing string to perform a stimulation operation in a second region of the well, pursuant to block 524.

Note that in each embodiment described above, the tools 50 or 210 disposed along the length of the tubing string may all have substantially the same opening size when in the object pass through state; and similarly the tools 50 or 210 disposed along the length of the tubing string may all have substantially the same opening size when in the object catching state. Thus, each dropped object 90 may be approximately the same size in outer perimeter, and each dropped object 90 will pass through all of the tools 50 or 210 which are in the object pass through state, and will only land in tools 50 or 210 which are in the object catching state.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. A method comprising:

deploying a string comprising a tool in a well;

perforating a designated region of the tool, the perforating causing a seat of the tool to shift from a first position which the seat is adapted to allow an object deployed in the string to pass through the seat to a second position in which the seat is adapted to catch the object to form a fluid barrier in the string;

deploying the object into the string using a perforating gun and releasing the object from the perforating gun so that the object becomes untethered in the string;

catching the object on the seat to form the fluid barrier; and diverting fluid in the string using the fluid barrier.

2. The method of claim 1, wherein the string comprises a casing string.

3. The method of claim 1, wherein the perforating comprises generating at least one perforating jet to breach a chamber of the tool, wherein the chamber at least partially resides in the designated region.

4. The method of claim 1, wherein the perforating comprises communicating an abrasive fluid to abrade a wall of a chamber of the tool to breach the chamber.

5. The method of claim 1, wherein the perforating comprises breaching a chamber of the tool, the chamber initially containing a pressure lower than a pressure of a surrounding well environment.

6. The method of claim 5, further comprising radially compressing a compressible element of the seat restrict a passageway of the string in response to the breaching.

7. The method of claim 1, wherein the diverting comprises diverting fluid communicated from an Earth surface into a formation.

8. The method of claim 1, further comprising:

shifting another seat of the tool from a third position in which the other seat is adapted to allow another untethered object communicated through the string to pass through the other seat to a fourth position in which the other seat is adapted to catch the other object to form another fluid barrier; and diverting fluid using the other fluid barrier.

9. The method of claim 8, wherein the performing comprises performing a fracturing operation or an acidizing operation.

10. The method of claim 1, further comprising:

performing a stimulation operation using the diverting of the fluid.

* * * * *